US006533247B1

(12) United States Patent
Dhein

(10) Patent No.: US 6,533,247 B1
(45) Date of Patent: Mar. 18, 2003

(54) UNIVERSAL LIFT SYSTEM

(76) Inventor: Scott Dhein, 901 Dairyland Rd., Cleveland, WI (US) 53015

( * ) Notice: Subject to any disclaimer, the term of this patent is extended or adjusted under 35 U.S.C. 154(b) by 0 days.

(21) Appl. No.: 09/710,507

(22) Filed: Nov. 9, 2000

Related U.S. Application Data

(62) Division of application No. 09/366,874, filed on Aug. 4, 1999, now Pat. No. 6,168,138.

(51) Int. Cl.[7] ..... B66F 3/00
(52) U.S. Cl. ..... 254/134
(58) Field of Search ..... 254/133, 134, 254/8 R, 8 B, 1, DIG. 1, DIG. 4

(56) References Cited

U.S. PATENT DOCUMENTS 2,747,837 A 5/1956 Turner
2,903,258 A 9/1959 Jovanovich
4,570,905 A 2/1986 Gerstner
4,607,823 A 8/1986 Thomas
4,793,592 A 12/1988 Green et al.
4,964,617 A 10/1990 Lawrence
5,139,233 A * 8/1992 Goss ..... 254/134
5,294,098 A 3/1994 Bundy
5,588,639 A 12/1996 Holman
5,769,397 A * 6/1998 Dhein ..... 254/134

* cited by examiner

*Primary Examiner*—Robert C. Watson
(74) *Attorney, Agent, or Firm*—Andrus, Sceales, Starke & Sawall, LLP

(57) ABSTRACT

An universal lift system for use in combination with a lifting device which is particularly suitable for lifting and supporting two wheeled motorized vehicles such as motorcycles, mopeds, and the like in an elevated position so that maintenance may be easily performed on the vehicle. The lift system includes an attachment device comprising a base plate and cross members fastened to the base plate for mounting on the lifting device. The lift system further includes an adjustable support device, which may be used alone or in combination with the attachment device for maintaining the vehicle in a raised position while the lifting device may be removed from underneath the vehicle and the attachment device. Mounting brackets may be attached to the attachment device or support device for supporting a wide variety of vehicles and/or parts. The lift system further includes a stabilizing device which attaches to the lifting device to prevent the lifting device from tipping over while supporting the weight of a vehicle or part on the attachment device. The lift system may further include a tool caddy and an oil drain pan which are attachable to the attachment device.

4 Claims, 10 Drawing Sheets

UNIVERSAL LIFT SYSTEM

This application is a division of application Ser. No. 09/366,874, filed Aug. 4, 1999 now U.S. Pat. No. 6,168,138.

BACKGROUND OF THE INVENTION

The present invention relates to lifting devices, and more particularly to a universal lift system that is used in combination with a lifting device for lifting and supporting two-wheeled motorized vehicles, such as motorcycles and mopeds off the ground so that they may be more easily serviced and/or repaired. The apparatus of the present invention may also be used for lifting and supporting personal watercraft, engines, transmissions, differentials, etc.

The prior art describes many types of lifting devices and attachments for lifting devices. These lifting devices include center post hydraulic jacks, scissors type articulated jacks and screw operated jacks.

Of direct interest to the present invention, is a hand operated hydraulic floor jack which is relatively small, convenient, portable and economically available to even the smallest of automobile repair shops, garage mechanics and private persons.

When lifting automobiles or other four-wheeled motorized vehicles, the saddle of the hand operated hydraulic floor jack is placed underneath the automobile near the axle of the wheel to be elevated. The other three wheels of the vehicle remain on the ground and provide stability for the vehicle while the jack is elevating one of the wheels.

Unfortunately, two-wheeled motorized vehicles such as motorcycles and mopeds are generally unstable when lifted with a jack. This is especially so if one or both of the wheels is lifted off the ground. As a result, most of the repair work done on motorcycles or mopeds is done with the vehicle having both wheels on the ground. This requires a person doing maintenance on the vehicle to crouch down in a generally uncomfortable position while working on the vehicle. It is much easier to work on the vehicle in an elevated position. Therefore, it is desirable to lift the two-wheeled motorized vehicle off the ground so that a person can more easily repair and maintain the vehicle.

The present invention provides a universal lift system which is attachable to a hydraulic floor jack for lifting and supporting two-wheeled motorized vehicles off the ground at an elevation high enough so that maintenance can be performed in a comfortable position, while maintaining the stability of the vehicle.

SUMMARY OF THE INVENTION

The present invention is directed to a universal lift system which includes an attachment device for attachment to a wide variety of jacks for lifting and supporting a wide variety of makes and models of motorcycles, mopeds, and other devices.

The universal lift system is used in combination with a lifting device or jack for lifting a two wheeled vehicle or vehicle part. The lifting device includes a base positionable on the ground and an upwardly movable arm connected to the base, with the arm having an opening in an end thereof for attachment of an attachment device of the present invention. The attachment device is mounted to the lifting device for lifting a vehicle or vehicle part off the ground. The attachment device includes a base plate having a top surface and a bottom surface, with a plurality of slotted openings extending therethrough. At least two cross members are fastened to the base plate along the slotted openings, so that the cross members may be slidably adjusted along the length of the slotted openings in the base plate. The cross members preferably include at least two slotted openings extending therethrough and at least two holes extending therethrough for attachment of mounting brackets to mate with the frame of the vehicle, or the attachment of a tool caddy and oil drain pan to the cross members. The cross members may embody different configurations for different applications.

A kingpin extends downwardly from the bottom surface of a base plate for insertion into the opening into the arm of the lifting device to attach the attachment device to the lifting device so that the upward movement of the arm raises the vehicle supported by the attachment device off the ground. The kingpin is split in half along a diagonal line and includes a first half rigidly attached to the bottom surface of the base plate, and a second half loosely attached to the first half by an expansion/locking bolt.

The universal lift system further includes a stabilizing device attached to the base of the lifting device for preventing the lifting device from tipping over while supporting the weight of a vehicle or part off the ground. The stabilizing device includes a support plate having a top surface and a bottom surface and a pair of brackets attached to the top surface of a support plate. The brackets each have a horizontal portion which is attached to the top surface of a support plate and a vertical portion extending upwardly from the horizontal portion for clamping to the sides of the base of the lifting device. At least one of the L-shaped brackets is horizontally adjustable along the top surface of the support plate so that it may be attached to the sidewalls of the base of a lifting device. The stabilizing device may also include at least two wheels attached thereto for allowing the stabilizing device to be moved with the wheeled lifting device while still attached to the lifting device. In addition, the vertical portions of the brackets may include at least one slotted opening extending therethrough for adjusting the vertical position of the stabilizing device on the lifting device so that the stabilizing device may be raised during movement of the lifting device, and lowered to rest on the ground when a vehicle is raised by the lifting device. The stabilizing device may further include leveling bolts extending through the support plate for leveling the stabilizing device while attached to the lifting device.

The universal lift system further includes a support device for additionally supporting the attachment device. The support device allows the removal of the attachment device from the lifting device so that the lifting device may be used elsewhere. The support device may be used alone or in combination with the attachment device for supporting a vehicle or vehicle part in a raised position. The support device includes at least two frame members adjustably interconnected together with at least two wheels attached to the bottoms of the frame members and at least two horizontal members attached to the top of the frame members for supporting the attachment device for a vehicle. The horizontal members having a plurality of holes extending therethrough for attachment of the attachment device or mounting brackets for mating with the frame of a vehicle or vehicle part.

The support device is horizontally adjustable through the use of attachment members extending outwardly from each of the frame members and being slidably interconnected with one another and locked in place by a locking bolt or other fastener. The support device may also be vertically adjustable through the use of vertical extension members extending upwardly from the bottoms ends of the frame members, the vertical extension members having a plurality of holes extending therethrough. The frame members also include sleeve members attached thereto for receiving the vertical extension members therein, the sleeve members having holes extending therethrough to match the holes in the vertical extension members. The sleeve members are slidingly interconnected on the vertical extension members with the frame members being locked in place by pins inserted into the matching holes of the sleeve members and the vertical extension members to adjust the height of the support device.

Various other features, objects, and advantages of the invention will be made apparent from the following detailed description and the drawings.

DETAILED DESCRIPTION OF THE INVENTION

Figure 1:
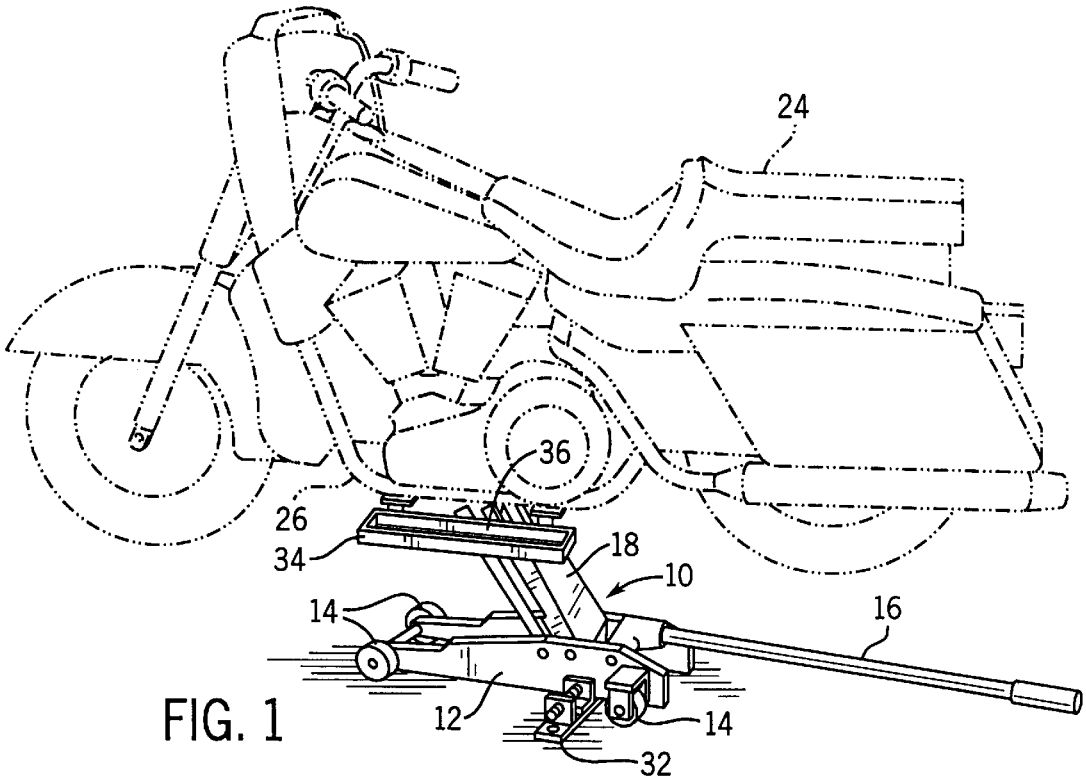
FIG. 1 is a perspective view of a motorcycle being supported by an attachment device mounted to the lifting arm of a jack in accordance with the present invention.
Figure 2:
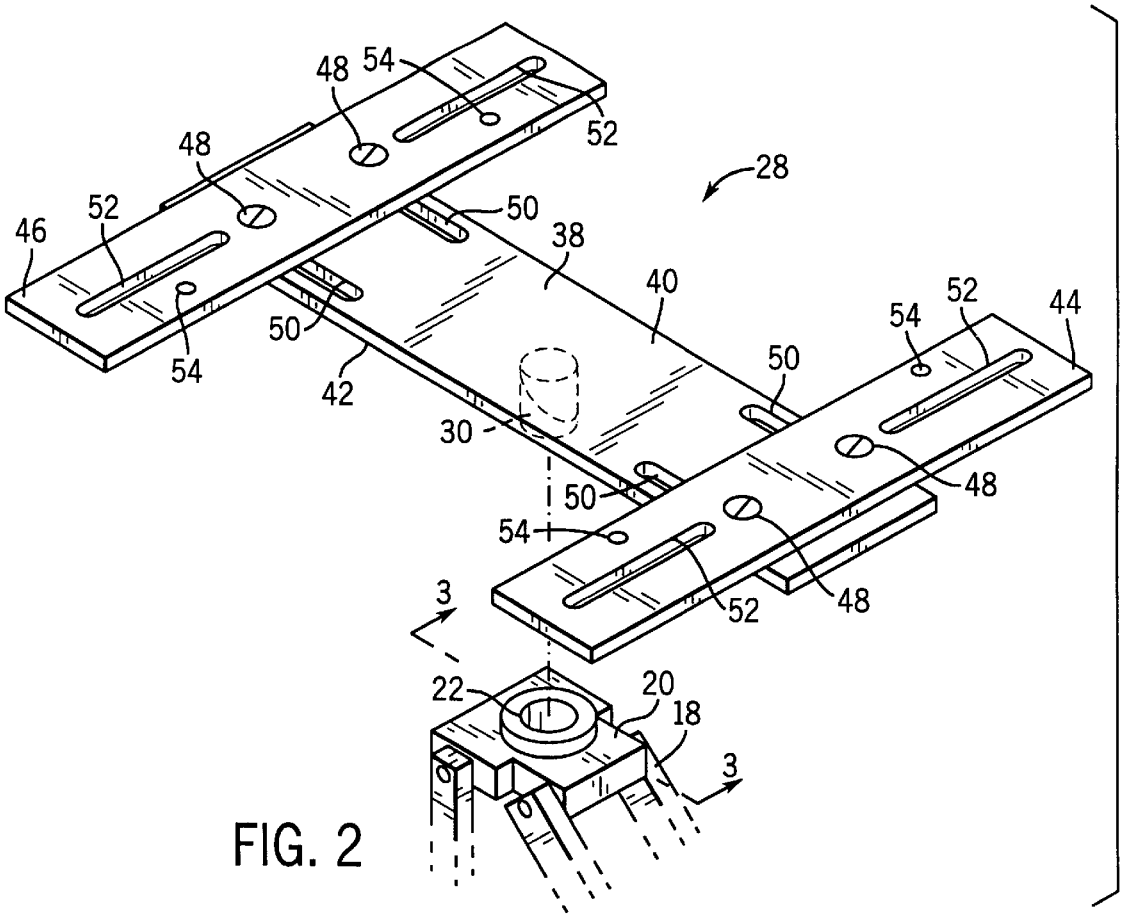
FIG. 2 is an exploded perspective view of the attachment device and mounting bracket on the lifting arm of the jack of FIG. 1.

FIG. 1 shows a jack 10 commonly used in automobile repair shops, which includes a base 12, wheels 14, an operating handle 16, a lifting arm 18, and a mounting bracket 20, FIG. 2, attached to the end of the lifting arm 18. The mounting bracket 20, FIG. 2, includes a circular opening 22 for mounting a removable saddle therein.

Typically, a motorcycle 24 is elevated by placing the saddle beneath the frame 26 of the motorcycle and cranking the handle 16, which raises the lifting arm 18 of the jack 10. However, the saddle creates an unstable condition for lifting and supporting the motorcycle 24 off the ground.

In the present invention, the saddle is removed from the mounting bracket 20 and replaced by an attachment device 28 which is removably attached to the jack 10 by inserting a kingpin 30 extending downwardly from attachment device 28 into the circular opening 22 in the mounting bracket 20 of lifting arm 18. The jack 10 is then placed underneath the motorcycle frame 26 in alignment with those parts of the motorcycle frame most suitable for supporting the weight of the motorcycle 24. FIG. 1 also shows a stabilizing device 32 attached to the base 12 of the jack 10 for stabilizing and preventing the jack 10 from tipping over while supporting the weight of the motorcycle 24. A tool caddy 34 and an oil drain pan 36 are also shown attached to the attachment device 28.

FIG. 2 illustrates the attachment device 28 of the present invention. The attachment device 28 includes a base plate 38, the base plate 38 having a top surface 40 and a bottom surface 42 and an adjustable kingpin 30 extending downwardly from the bottom surface 42 of the base plate 38, and a pair of cross members 44, 46 attached transversely across the base plate 38. The cross members 44, 46 are attached to the base plate 38 by a plurality of fasteners 48 extending through the cross members 44, 46 and into slotted openings 50 in the base plate 38. The fasteners generally include screws, bolts, pins, rods, nuts, washers and the like. The slotted openings 50 allow the cross members 44, 46 to be slidingly adjustable along the lengths of the slotted openings 50.

The cross members 44, 46 each preferably include at least two slotted openings 52 extending longitudinally therethrough for accepting brackets for mounting the frame of a vehicle or part thereto. The cross members 44, 46 also include a plurality of through holes 54 for attaching a tool caddy 34 and an oil drain pan 36 to either end of the cross members 44, 46. The cross members 44, 46 may embody different configurations for different applications.

Figure 3:
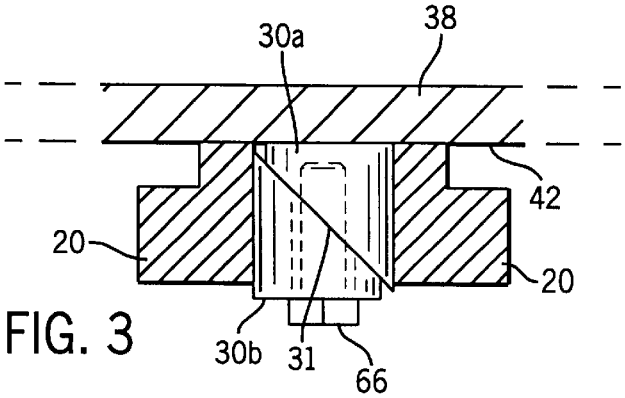
FIG. 3 is a cross-sectional view of the attachment device mounted to the mounting bracket taken along line 3—3 in FIG. 2.

FIG. 3 is a cross-sectional view of the attachment device 28 mounted to the jack 10. A kingpin 30 extends downwardly from the bottom surface 42 of the base plate 38 and is inserted into the circular opening 22 in the mounting bracket 20. An expansion/locking bolt 66 is provided within the kingpin 30 to expand and tighten the kingpin 30 within the circular opening 22 of the mounting bracket 20. The kingpin 30 is split in half along a diagonal line 31 and includes a first half 30*a* rigidly attached to the bottom surface 42 of the base plate 28 and a second half 30*b* loosely attached to the first half 30*a* by the expansion/locking bolt 66. Tightening the bolt 66 expands the kingpin 30*a*, 30*b*, locks it in place within the opening 22, and prevents rotation of the attachment device 28. Loosening the bolt 66 allows the attachment device 28 to be rotated through 360° of rotation for positioning an elevated vehicle or part in any desired angular position on the jack 10. The kingpin 30 pivots in the opening 22 so that the raised vehicle maybe secured in any desired angular swiveled position.

Figure 7:
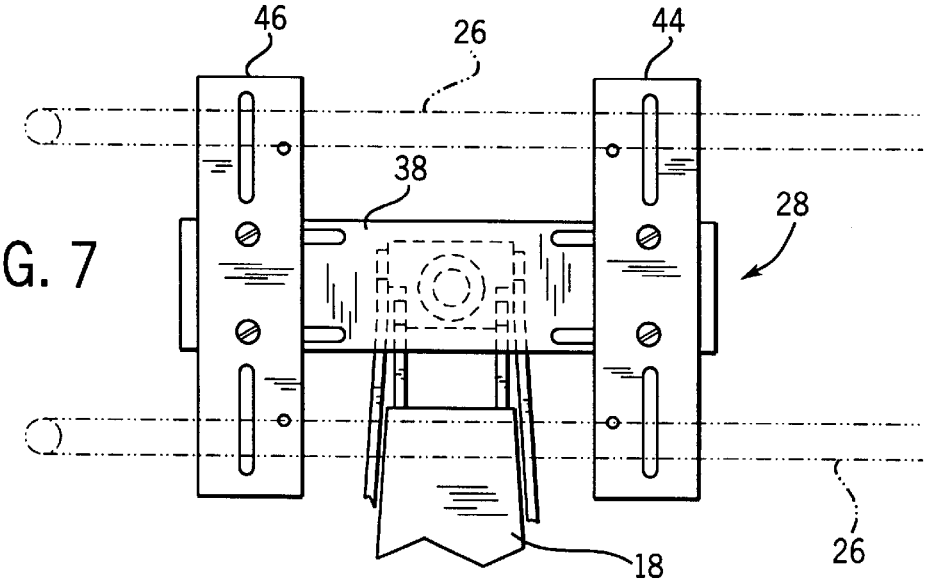
FIG. 7 is a top plan view of an attachment device mounted to the lifting arm of a jack for supporting the frame of a motorcycle.

The jack 10 is brought underneath the frame 26 of the motorcycle 24 as shown in FIG. 7. The jack 10 is elevated by cranking the handle 16 which raises the lifting arm 18 of the jack 10 so that the attachment device 28 comes into contact with the frame 26 of the motorcycle 24. The jack 10 is then raised further to lift the motorcycle 24 off the ground.

Figure 16:
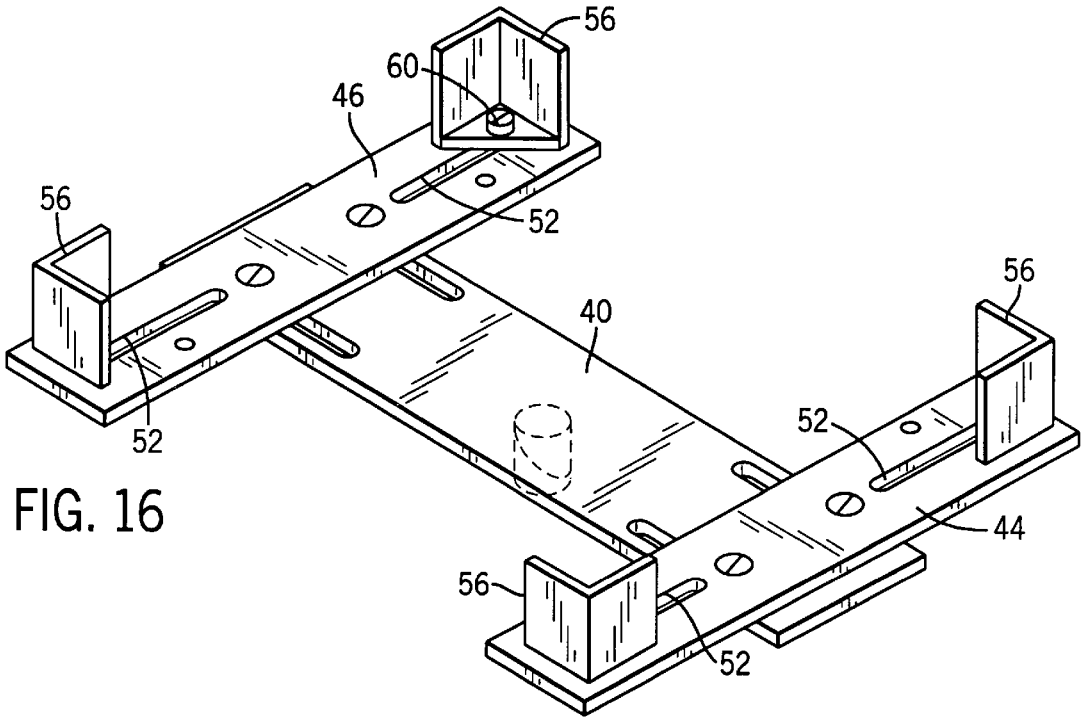
FIG. 16 is a perspective view of an attachment device with brackets mounted to cross members of the attachment device.

FIG. 16 shows the attachment device 28 of the present invention with brackets 56 removably fastened to the slotted openings 52 of the cross members 44, 46 for mounting a vehicle or part on the attachment device 28. The position of the brackets 56 may be adjusted by sliding them along the length of the slotted openings 52 and securing them in place with fasteners 60.

Figure 17:
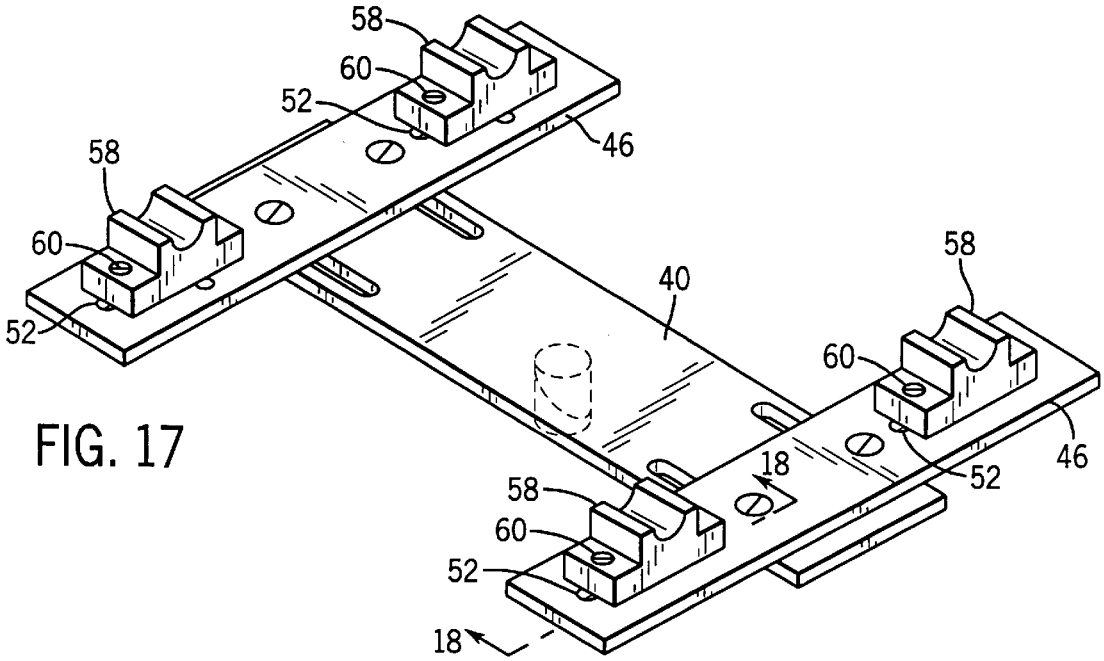
FIG. 17 is a perspective view of an attachment device with pillow blocks mounted to cross members of the attachment device.

FIG. 17 illustrates another type of bracket or pillow block 58 removably fastened to the slotted openings 52 of the cross members 44, 46 for engaging the frame of a vehicle or part that is lifted and supported by the attachment device 28. the pillow blocks 58 position may be adjusted by sliding them along the length of the slotted openings 52 and securing them in place with fasteners 60.

Figure 18:
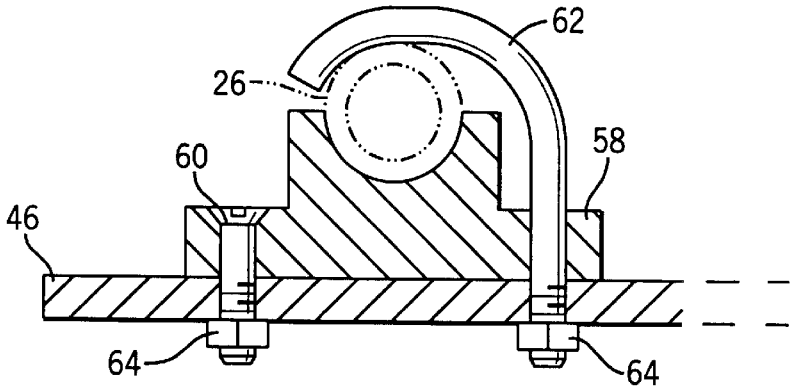
FIG. 18 is a cross-sectional view of the pillow block mounted to the cross member taken along line 18—18 in FIG. 17 and showing the use of a J-clamp for securing the frame of a motorcycle to the pillow block.

FIG. 18 shows a cross sectional view of one of the pillow blocks 58 secured in one of the slotted openings 52 of the cross member 46. A clamp 62 is shown securing the frame 26 of a motorcycle or other vehicle part to the pillow block 58.

Figure 20:
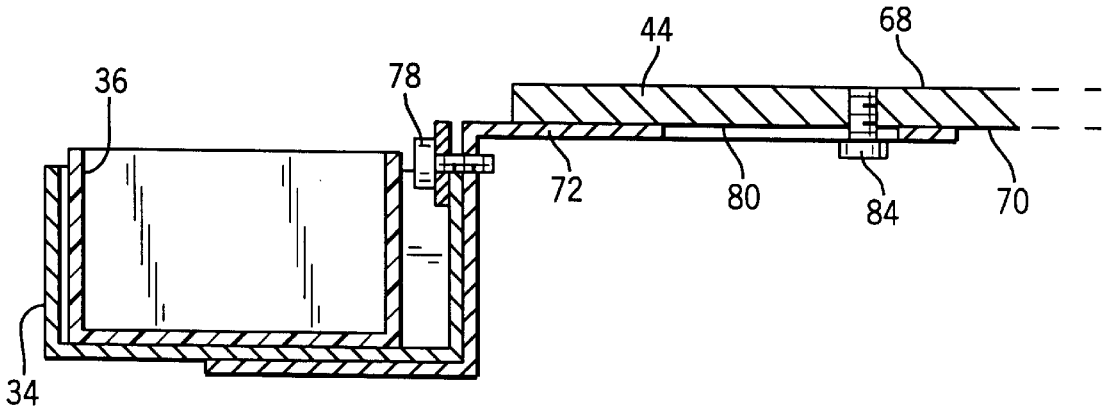
FIG. 20 is a cross-sectional view of the tool caddy and oil drain pan attached to the cross members taken along line 20—20 in FIG. 19.
Figure 19:
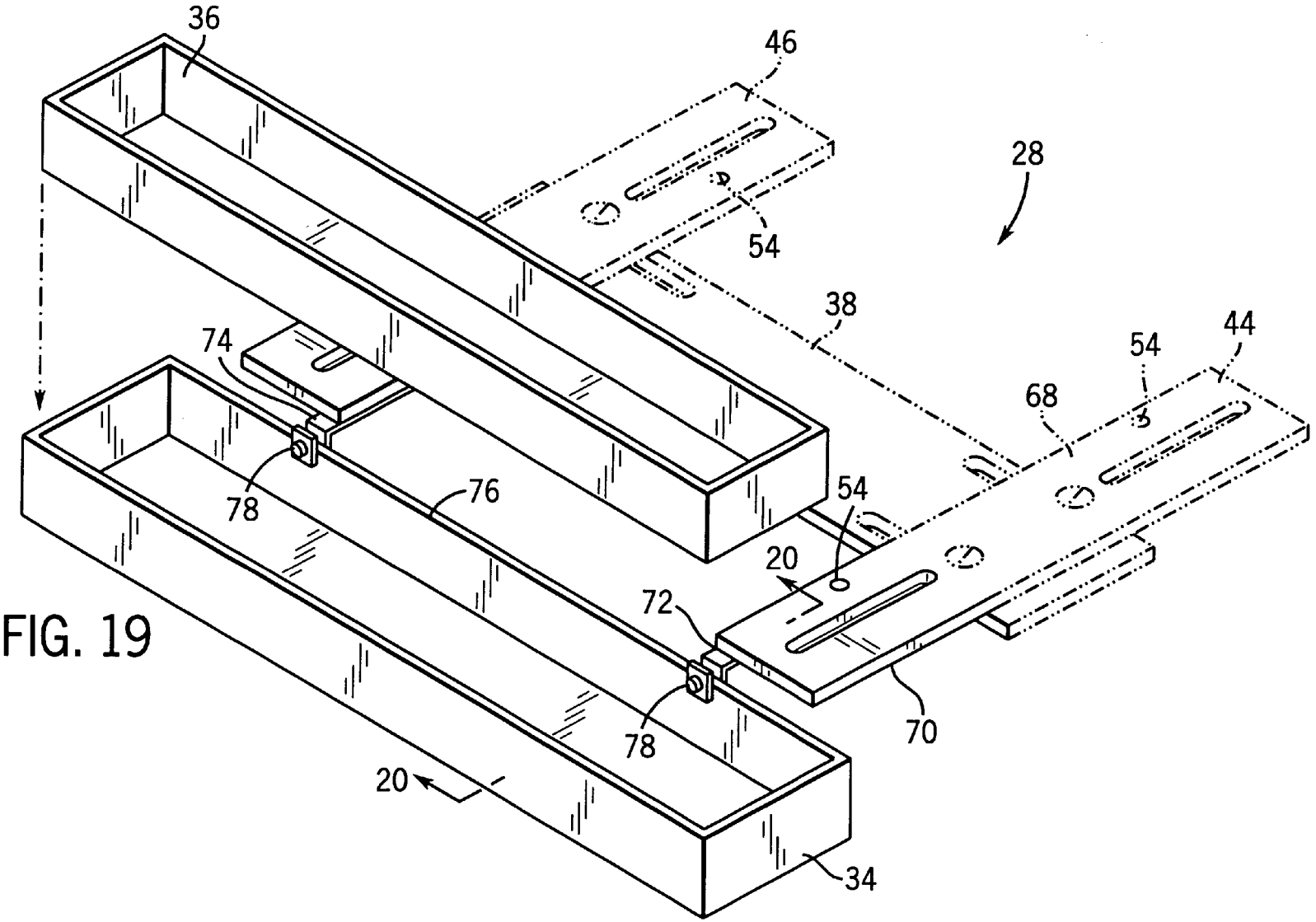
FIG. 19 is an exploded perspective view of a tool caddy and oil drain pan attached to the cross members of an attachment device.

FIG. 19 illustrates the attachment device 28 including the base plate 38 and cross members 44, 46 attached thereto with a tool caddy 34 mounted to the cross members 44, 46. The cross members 44, 46 each having a top surface 68 and a bottom surface 70. The tool caddy 34 includes a pair of arms 72, 74 fastened to a sidewall 76 of the tool caddy 34 by fasteners 78, the arms 72,74 extending outwardly from the sidewall 76 for attachment to the cross members 44, 46. The arms 72, 74 are preferably flat and include slotted openings 80, 82 extending through each of the arms 72, 74 to allow insertion of a fastener 84, 86, such as a threaded screw or bolt for fastening the tool caddy 34 to the cross members 44, 46. The fastener 84 is inserted through the bottom of the opening 80 and into the throughhole 54 in cross member 44 as shown in FIG. 20. The openings 80, 82 in the arms 72, 74 are slotted so that the tool caddy 34 may be adjusted horizontally.

The arms 72, 74 of the tool caddy 34 are preferably attached to the bottom surface 70 of the cross members 44, 46, as shown in FIG. 20, but may also be attached to the top surface 68 of the cross members 44, 46. As shown in FIG. 20, the oil drain pan 36 is inserted into the tool caddy 34 as needed. Otherwise, the tool caddy 34 may be used as an attachment for holding tools and other accessories necessary for maintaining and repairing a vehicle or vehicle part mounted to the attachment device 28.

Figure 4:
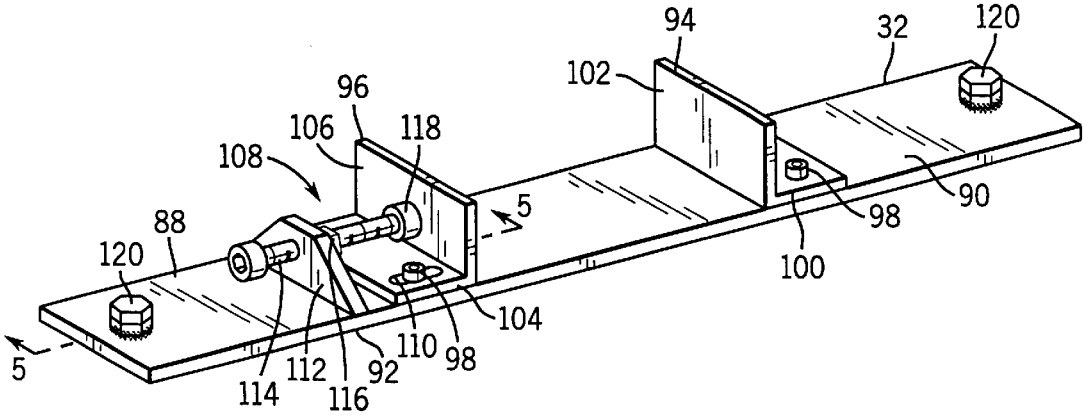
FIG. 4 is a perspective view of a first embodiment of a stabilizing device which attaches to the base and sidewalls of the jack of FIG. 1.
Figure 5:
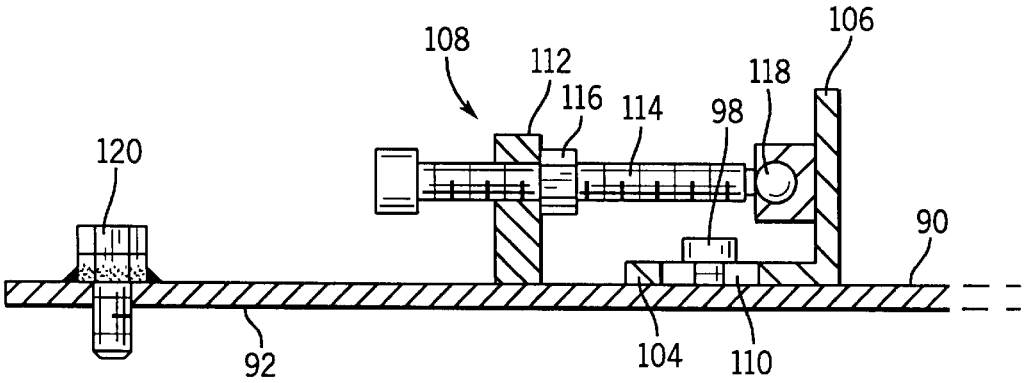
FIG. 5 is a cross-sectional view of the adjustable portion of the stabilizing device taken along line 5—5 in FIG. 4.

FIG. 4 shows a first embodiment of a stabilizing device 32 that may be attached to the base 12 of a jack 10. The stabilizing device 32 includes a support plate 88 having a top surface 90 and a bottom surface 92, fixed angle bracket 94 and an adjustable angle bracket 96. The stabilizing device 32 prevents the jack 10 from tipping over while supporting the weight of a vehicle or vehicle part mounted on the attachment device 28. The fixed angle bracket 94 is an L-shaped bracket having a horizontal portion 100 and a vertical portion 102 extending upwardly from one side of the horizontal portion 100. The horizontal portion 100 is rigidly attached to the top surface 90 of the support plate 88 by fasteners 98. The vertical portion 102 is placed against a sidewall of a jack. The adjustable angle bracket 96 is also an L-shaped bracket including a horizontal portion 104 and a vertical portion 106 extending upwardly from one side of the horizontal portion 104. The adjustable angle bracket 96 is part of an adjustment mechanism 108 shown in FIG. 5 for adjusting the horizontal position of the adjustable angle bracket 96. The vertical portion 106 is placed against the opposite sidewall of the jack. The horizontal portion 104 of the adjustable angle bracket 96 includes slotted openings 110 extending therethrough for slidingly adjusting the adjustable angle bracket in a horizontal position. The adjustment mechanism 108 includes a fixed bracket 112 extending upwardly from the top surface 90 of the support plate 88 for holding an adjusting bolt 114 which adjusts the horizontal position of the adjustable angle bracket 96. The adjusting bolt 114 is preferably a threaded bolt or screw which extends through an opening in the fixed bracket 112 and further through a nut 116 attached to the fixed bracket 112 and is attached to a mounting mechanism 118 on the vertical portion 106 of the adjustable angle bracket 96. Once the vertical portion 106 of the adjustable angle bracket 96 is placed against a sidewall of a jack by turning adjusting bolt 114, the adjustable angle bracket 96 is locked in place by tightening fasteners 98 extending through slotted openings 110. The stabilizing device 32 also includes leveling bolts 120 extending through the support plate 88 at each end thereof for leveling the jack on the ground.

Figure 21:
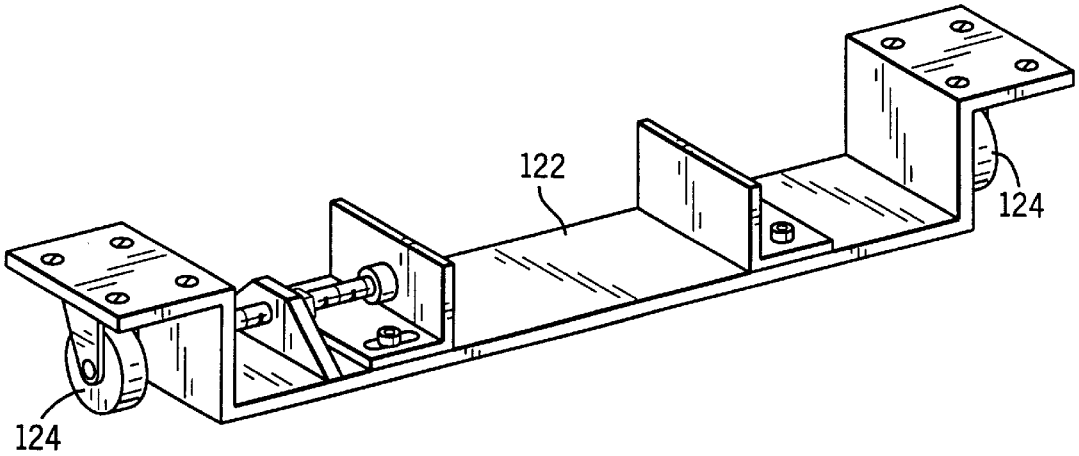
FIG. 21 is a perspective view of a second embodiment of the stabilizing device of FIG. 4.

FIG. 21 shows a second embodiment of a stabilizing device 122 with wheels 124 attached to the ends of the device 122 so that the device does not have to be removed from the jack when the jack is moved around. The stabilizing device 122 is attached to the sidewalls of a jack and moves around with the jack on its wheels 124.

Figure 22:
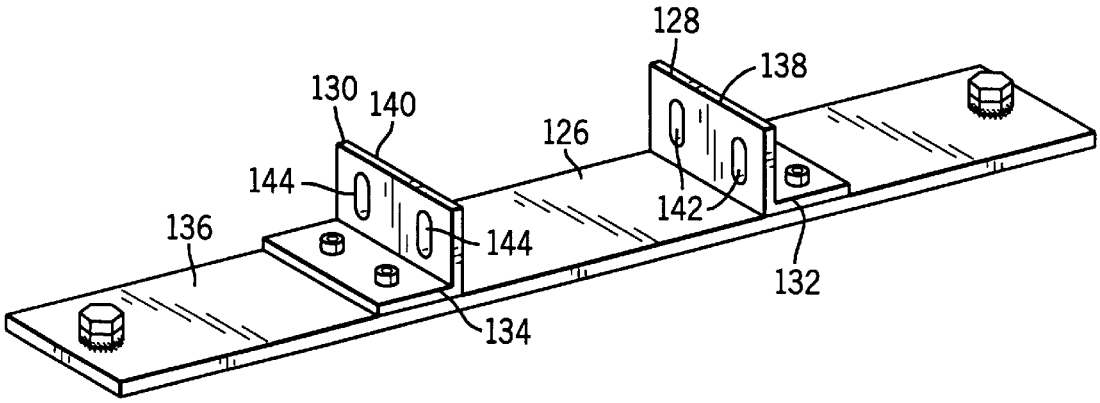
FIG. 22 is a perspective view of a third embodiment of the stabilizing device of FIG. 4.

FIG. 22 shows a third embodiment of a stabilizing device 126. In this embodiment, the stabilizing device 126 includes two fixed angle brackets 128, 130. The L-shaped brackets 128, 130 are mirror images of each other and each have a horizontal portion 132, 134 attached to a support plate 136 and a vertical portion 138, 140 extending upwardly from one side of the horizontal portions 132, 134. The vertical portions include slotted openings 142, 144 extending therethrough for attaching the stabilizing device 126 to the sidewalls of a jack with fasteners (not shown). The slotted openings 142, 144 allow the stabilizing device 126 to be raised and lowered while still attached to the jack, thereby allowing the stabilizing device 126 to be attached to the jack at all times. When the jack is moved, the stabilizing device 126 is raised through the use of the slotted openings 142, 144 in the vertical portions 138, 140 of the brackets 128, 130 so that the stabilizing device 126 does not interfere with movement of the jack. When the jack is used for lifting, the stabilizing device 126 is lowered into contact with the ground for stabilizing the jack.

Figure 11:
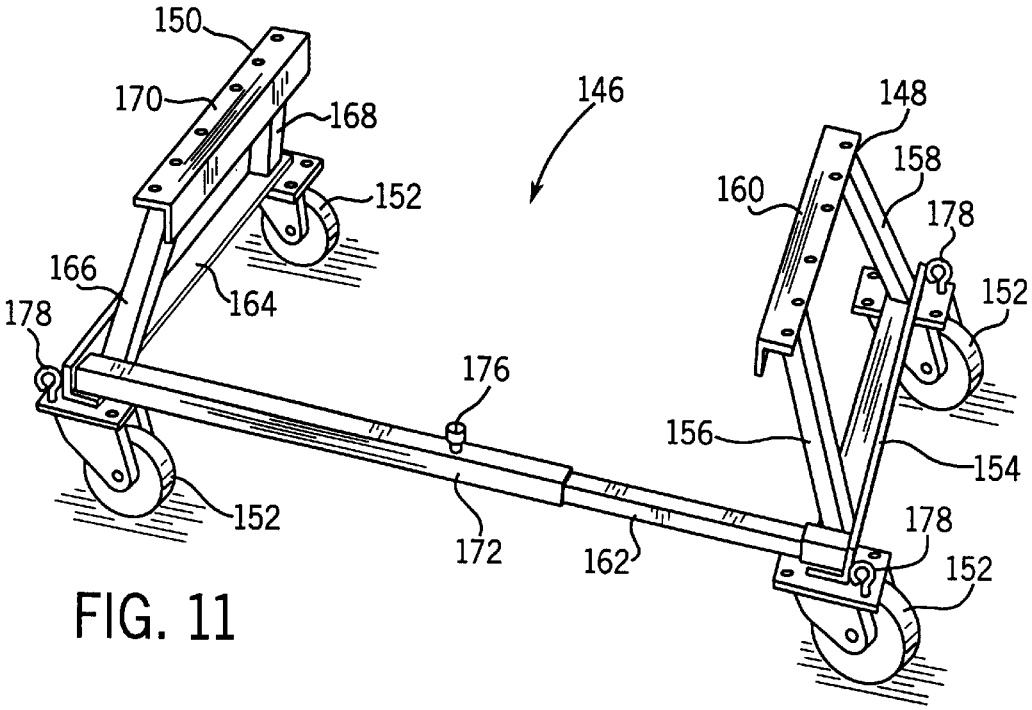
FIG. 11 is a perspective view of a first embodiment of an adjustable support device.

FIG. 11 shows an adjustable support device 146 which may be used alone or in combination with the attachment device 28 to support a motorcycle, or other vehicle or vehicle part off the ground. The adjustable support device 146 is generally a three-sided wheeled device with an open end. The adjustable support device 146 includes a first frame member 148 and a second frame member 150 which are interconnected to one another. The first frame member 148 and the second frame member 150 each include at least two wheels for supporting and allowing maneuvering ability of the adjustable support device 146. The first frame member 148 includes a first horizontal member 154 spanning the two wheels 152, two vertical members 156 and 158 extending upwardly from each end of the first horizontal member 154 above the wheels 152, and a second horizontal member 160 attached across the first and second vertical members 156, 158. Extending outwardly from one side of the first horizontal member 154 is an attachment member 162 for interconnecting the first frame member 148 with the second frame member 150.

The second frame member 150 is a mirror image of the first frame member 148 and includes a first horizontal member 164 spanning the two wheels 152, a pair of vertical members 166, 168 extending upwardly from the ends of the first horizontal member 164 at the wheels 152, and a second horizontal member attached across the first and second vertical members 166, 168. The second frame member 150 also includes an attachment tube 172 for insertion of the attachment member 162 of the first frame member 148 to form the adjustable support device 146. The attachment member 162 is slidably inserted into the attachment tube 172 along the length thereof and is locked in place by a locking bolt 176 extending through the attachment tube 172. The attachment member 162 and attachment tube 172 allow the adjustable support device to be adjusted to any specific width. The second horizontal members 160, 170 include a plurality of holes 174, 188 extending therethrough for attachment of mounting brackets and the attachment device 28 to the support device 146. The support device 146 also includes eyelets 178 located at each comer of the support device 146 for attachment of straps and the like to secure a vehicle or vehicle part to the support device 146.

Figure 12:
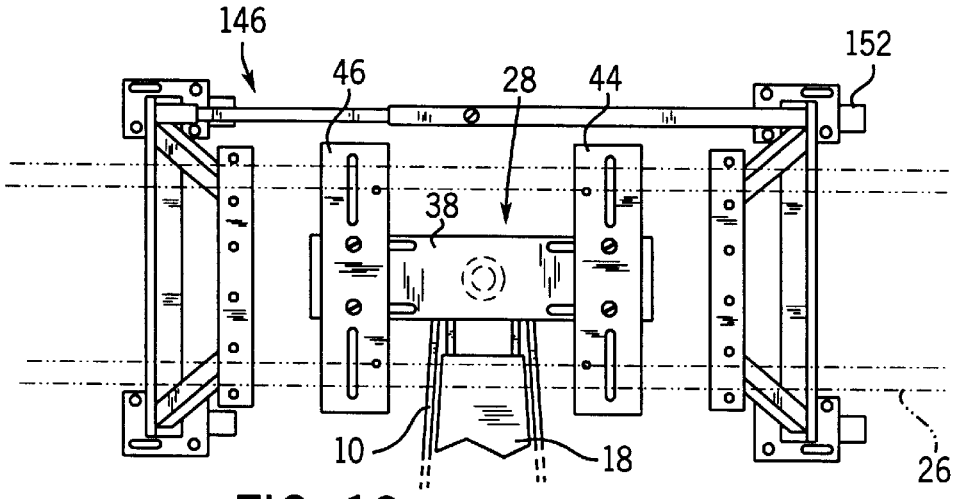
FIG. 12 is a top plan view of an adjustable support device positioned underneath an attachment device mounted to the lifting arm of a jack.

FIG. 12 shows an attachment device 28 mounted to the lifting arm 18 of a jack 10 to be used in combination with an adjustable support device 146 for supporting the frame 26 of a motorcycle. The support device 146 is positioned around the attachment device 28 with the jack extending out from the open end of the support device 146 as shown in FIG. 12.

Figure 9:
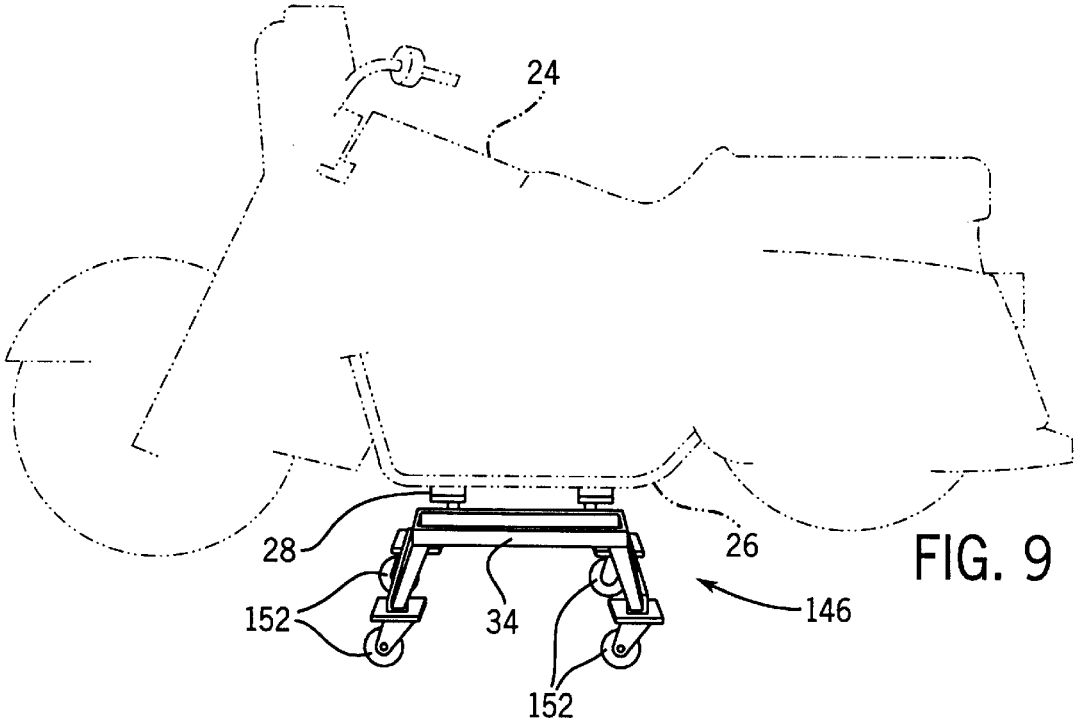
FIG. 9 is a perspective view of a motorcycle being supported by an adjustable support device.
Figure 10:
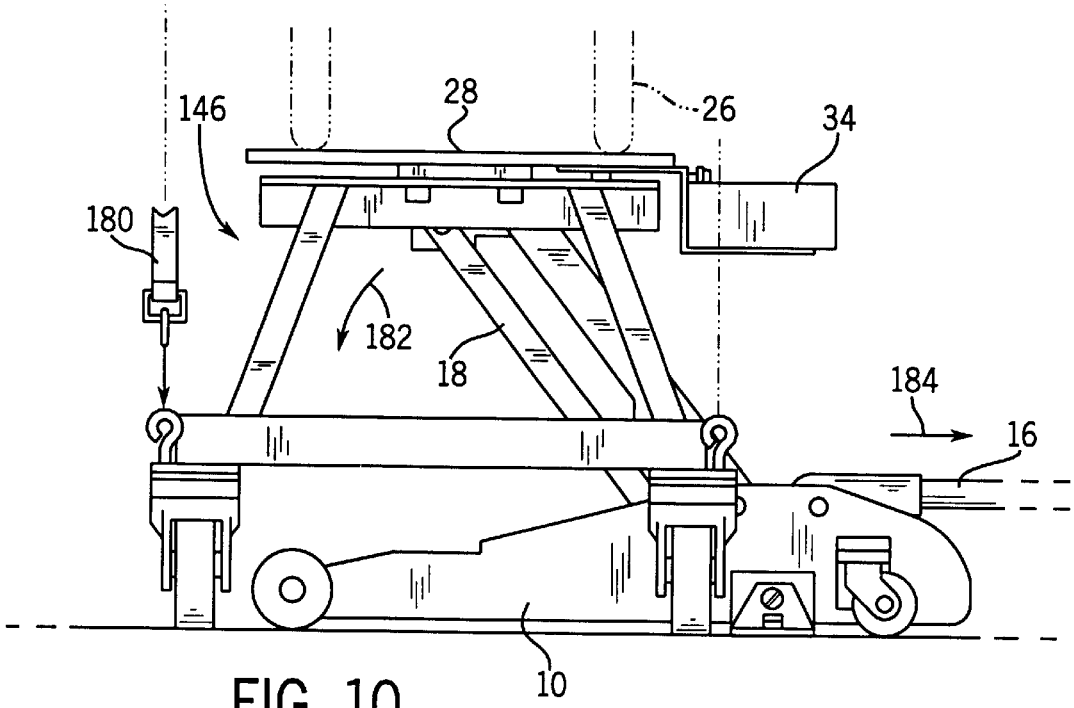
FIG. 10 is a side elevational view of a jack being removed from an attachment device attached to an adjustable support device supporting the frame of a motorcycle.

FIG. 10 is a side elevational view of the jack 10 being removed from the attachment device 28 after the attachment device 28 has been attached to the adjustable support device 146. The lifting arm 18 of the jack 10 is lowered as indicated by arrow 182 by cranking the handle of the jack 16. Once the lifting arm 18 of the jack 10 is lowered sufficiently so that the kingpin 30 is no longer inserted in the mounting bracket 20, the jack 10 is pulled out from underneath the frame 26 of the motorcycle as indicated by arrow 184 so that it may be used elsewhere. The motorcycle is supported by the attachment device 28 and the adjustable support device 146. FIG. 9 shows the frame 26 of the motorcycle 24 being supported by the attachment device 28 and the adjustable support device 146. In this arrangement, the motorcycle 24 may be moved around on the wheeled support device 146. Once motorcycle 24 is in a desired position or location, the wheels 152 may be locked to secure the motorcycle in place.

Figure 6:
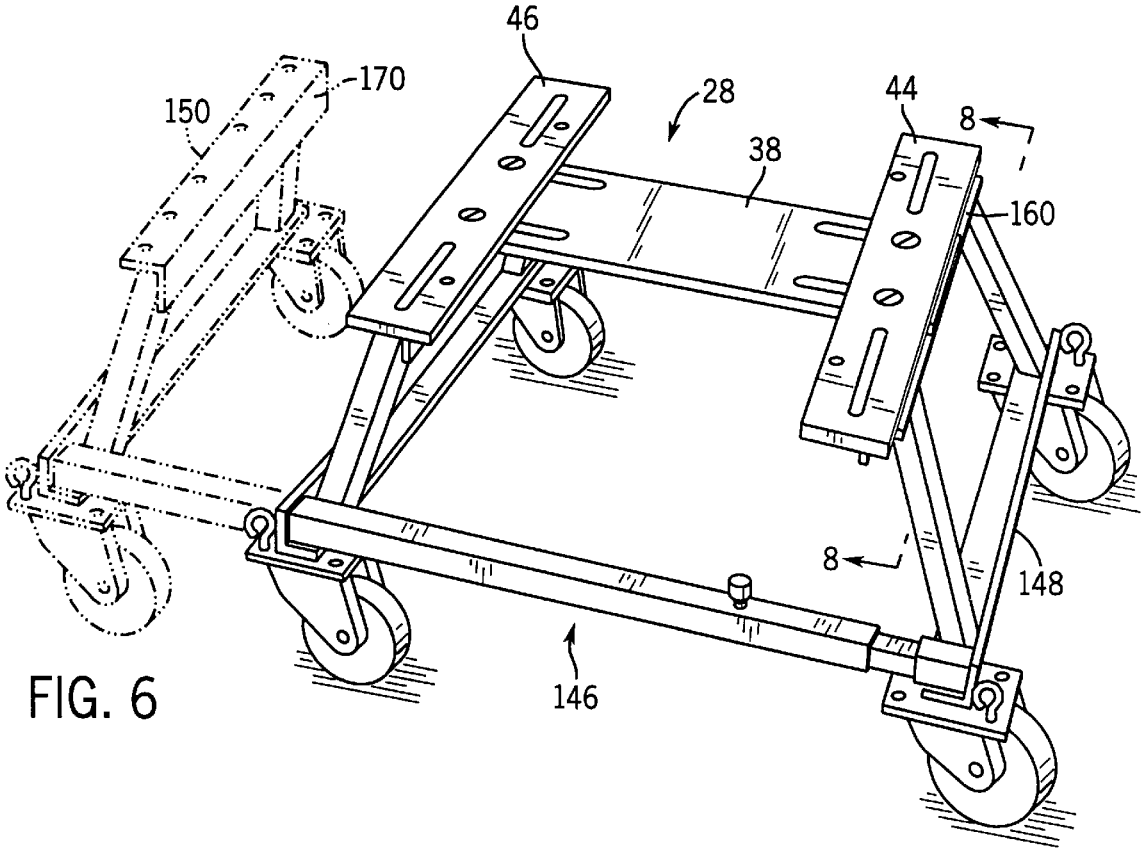
FIG. 6 is a perspective view of an attachment device attached to an adjustable support device.

FIG. 6 shows the adjustability of the support device 146. The second frame member 150 may be extended from the first frame member 148 by loosening the locking bolt 176 and separating the attachment member 162 from the attachment tube 172. The width of the support device 146 may be properly adjusted for attachment of the attachment member 28 to the second horizontal members 160 170 of the support device. A cross sectional view of attaching the attachment device 28 to the support device 146 is shown in FIG. 8.

Figure 8:
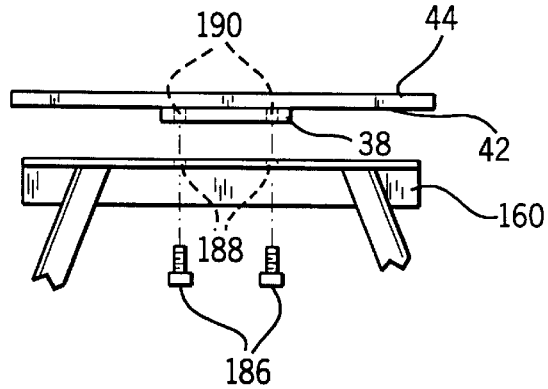
FIG. 8 is an exploded cross-sectional view of the attachment device attached to the adjustable support device taken along line 8—8 in FIG. 6.

In FIG. 8, the cross member 44 and base plate 38 are attached to the horizontal member 160 by fasteners 186 that extend up through holes 188 in the second horizontal member 160 and into openings in the bottom surface 42 of the base plate 38.

Figure 13:
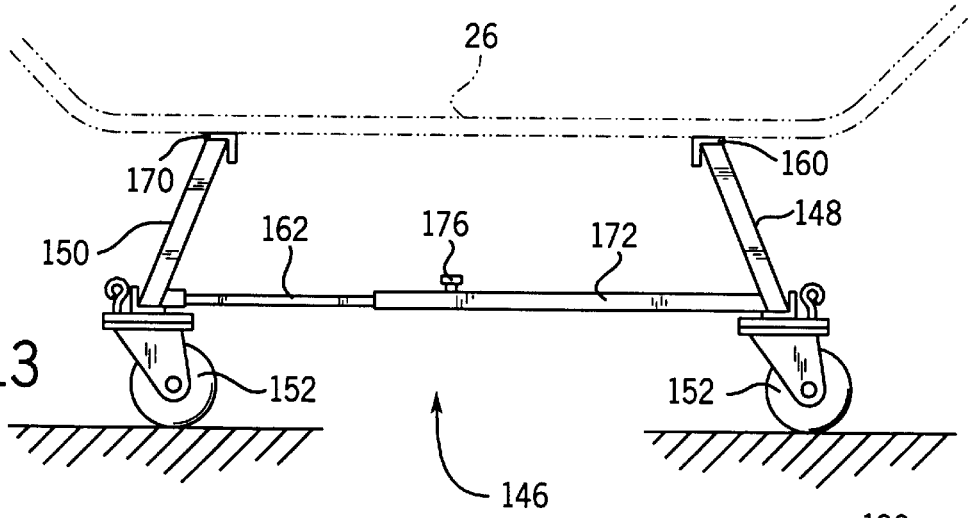
FIG. 13 is a side elevational view of an adjustable support device supporting the frame of a motorcycle.

FIG. 13 shows the support device 146 being used alone in supporting the frame 26 of a motorcycle. The frame 26 rests on top of the second horizontal members 160, 170 of the first and second frame members 148, 150 which are adjustable and interconnected by the attachment member 162 and attachment tube 172, and locked in place by locking bolt 176.

Figure 14:
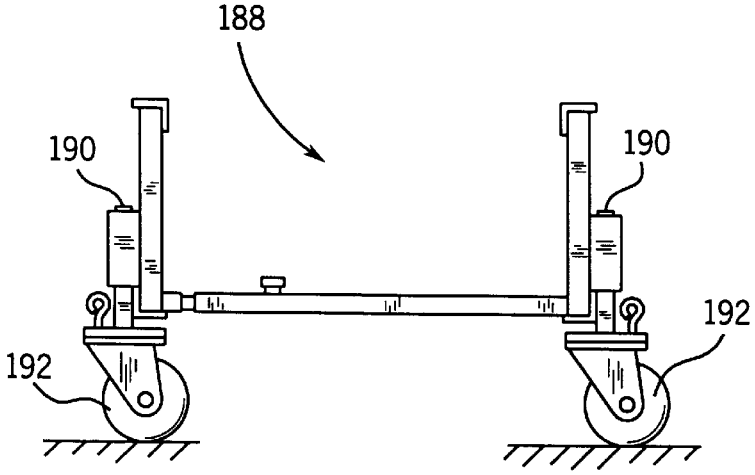
FIG. 14 is a side elevational view of a second embodiment of the adjustable support device of FIG. 11.
Figure 15:
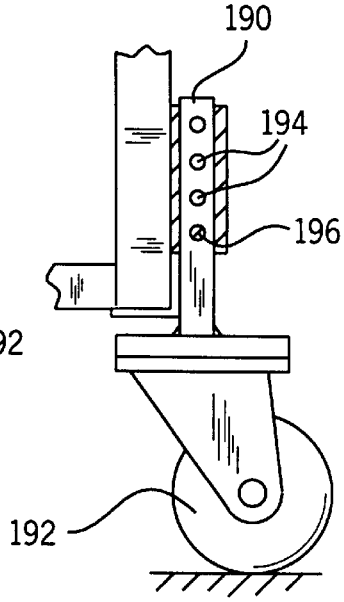
FIG. 15 is an enlarged side elevational view of the vertically adjustable frame of the adjustable support device of FIG. 14.

FIG. 14 illustrates a second embodiment of an adjustable support device 188. The adjustable support device 188 includes vertical adjustment posts 190 attached to each comer of the support device 188 above the wheels 192 as shown in FIGS. 14 and 15 for adjusting the height of the support device 188. The vertical adjustment posts 190 include a plurality of holes 194 extending therethrough for placement of a pin 196 to adjust the height of the support device 188. A sleeve 198 having a hole 204 extending therethrough is attached to the first 200 and second 202 frame members for placement over the vertical adjustment posts 190.

FIG. 15 is an enlarged side elevational view of the vertically adjustable frame of the adjustable support device of FIG. 14. The pin 196 is inserted through the holes 204 in the sleeves 198 and through a hole 194 in the vertical mounting posts 190 to secure the adjustable support device 188 at a desired height.

It is recognized that other equivalents, alternatives, and modifications aside from those expressly stated, are possible and within the scope of the appended claims. For example, the present invention has been described in connection with lifting and supporting two-wheeled motorized vehicles such as motorcycles, mopeds and the like. However, the invention may be used for lifting and supporting other vehicles and/or parts such as personal watercraft, engines, transmissions, differentials, etc.

What is claimed is:

1. An attachment device for attaching to a lifting device for lifting a two wheeled vehicle, the lifting device having a base positionable on the ground and an upwardly movable arm connected to the base, the arm having an opening in an end thereof for supporting the attachment device, the vehicle having a frame and supporting wheels spaced in tandem along a longitudinal axis of the vehicle, the attachment device comprising:

a base plate having a top surface and a bottom surface with a plurality of openings extending therethrough;

at least two cross members fastened to said base plate in the openings, said cross members mating with the frame of the vehicle when the base plate is brought into proximity with the vehicle, thereby supporting the vehicle;

a kingpin integrally connected to and extending downwardly from the bottom surface of the base plate for insertion into the opening in the arm of the lifting device to attach the attachment device to the lifting device so that the upward movement of the arm raises the vehicle supported by the attachment device off the ground, wherein the kingpin pivots in the opening in the arm of the lifting device to swivel the base plate through 360° of rotation, and wherein the kingpin further includes locking means for securing the base plate and raised vehicle in any desired angular swiveled position.

2. The attachment device of claim 1 wherein the cross members include a plurality of openings extending therethrough for attachment of a tool caddy for attachment of an oil drain pan.

3. The attachment device of claim 2 further comprising mounting brackets for attachment in the openings of the cross members.

4. An attachment device for attaching to a lifting device for lifting a two wheeled vehicle, the lifting device having a base positionable on the ground and an upwardly moveable arm connected to the base, the arm having an opening in an end thereof for supporting the attachment device, the vehicle having a frame and supporting wheels spaced in tandem along a longitudinal axis of the vehicle, the attachment device comprising:

a base plate having a top surface and a bottom surface with a plurality of openings extending therethrough;

at least two cross members fastened to said base plate in the openings, said cross members mating with the frame of the vehicle when the base plate is brought into proximity with the vehicle, thereby supporting the vehicle;

a kingpin integrally connected to and extending downwardly from the bottom surface of the base plate for insertion into the opening in the arm of the lifting device to attach the attachment device to the lifting device so that the upward movement of the arm raises the vehicle supported by the attachment device off the ground, wherein the kingpin is split in half along a diagonal line and includes a first half rigidly attached to the bottom surface of the base plate, and a second half loosely attached to the first half by an expansion/locking bolt.

* * * * *